US006867546B1

(12) United States Patent
Zhang et al.

(10) Patent No.: US 6,867,546 B1
(45) Date of Patent: Mar. 15, 2005

(54) PLASMA DISPLAY PANEL

(75) Inventors: Xiong Zhang, Jiangsu (CN); Bao-ping Wang, Jiangsu (CN)

(73) Assignee: Southeast University, Jiangsu (CN)

( * ) Notice: Subject to any disclaimer, the term of this patent is extended or adjusted under 35 U.S.C. 154(b) by 0 days.

(21) Appl. No.: 10/048,754

(22) PCT Filed: Oct. 10, 1999

(86) PCT No.: PCT/CN99/00161

§ 371 (c)(1),
(2), (4) Date: Jun. 6, 2002

(87) PCT Pub. No.: WO01/09917

PCT Pub. Date: Feb. 8, 2001

(30) Foreign Application Priority Data

Aug. 3, 1999 (CN) ..... 99114358 A

(51) Int. Cl.[7] ..... H01J 17/49
(52) U.S. Cl. ..... 313/584; 313/587; 315/169.4
(58) Field of Search ..... 345/60; 315/169.4; 313/582, 583, 584, 585, 586, 587

(56) References Cited

U.S. PATENT DOCUMENTS 5,264,758 A * 11/1993 Iijima et al. ..... 313/584
5,371,437 A * 12/1994 Amano ..... 315/169.1
5,503,582 A * 4/1996 Cathey et al. ..... 445/24
5,723,946 A * 3/1998 Park et al. ..... 313/607
6,483,238 B1 * 11/2002 Baret et al. ..... 313/582

FOREIGN PATENT DOCUMENTS

EP 0 448 727 A1 10/1991
EP 0 784 333 A2 7/1997
JP 06-196098 * 7/1994 ..... H01J/17/06

* cited by examiner

*Primary Examiner*—Edward J. Glick
*Assistant Examiner*—Elizabeth Keaney
(74) *Attorney, Agent, or Firm*—Westman, Champlin & Kelly, P.A.

(57) ABSTRACT

The plasma display panel of present invention comprises a front plate, a rear plate and a conductive mesh plate sandwiched between said front plate and said rear plate for supporting them. Said mesh plate includes an array of mashes which, together with the addressing electrode on said rear plate and the scanning electrode on said front plate, form the discharge cell of the display panel. Said mesh plate has gas conductive grooves on its surface in the region between adjacent mashes. The present invention has the advantage of higher resolution, brightness, and light transmissivity as well as lower operating voltage compared with those of the plasma display panel in prior art. In addition, the present invention provides high rate of finished products and low manufacturing cost.

18 Claims, 3 Drawing Sheets

PLASMA DISPLAY PANEL

The present application claims priority of International patent application Serial No. PCT/CN99/00161, filed 10 Oct. 1999, and published in Chinese, which claims priority to Chinese application Serial No. 99114358.2, filed 3 Aug. 1999, the contents of which are hereby incorporated by reference in their entirety.

FIELD OF THE INVENTION

The present invention relates to a plasma display panel, in particularly, to coplanar plasma display panel.

DESCRIPTION OF THE PRIOR ART

A conventional three electrodes surface discharge AC PDP comprises a front substrate and a rear substrate. The rear substrate includes a underlay glass plate, addressing electrodes on the surface of said underlay glass plate, a dielectric layer on the surface of said underlay glass plate embedding the addressing electrodes, rib walls on the dielectric layer made of dielectric materials to keep a discharge distance and prevent from disturb discharge. The front substrate comprises a glass plate for assembling with said rear substrate, common electrodes and transparent scanning electrodes alternately on the bottom surface of the glass plate in a striped pattern being perpendicular to said addressing electrodes, a dielectric layer formed on the bottom surface of the front glass plate including common and transparent scanning electrodes. Some working gases, e.g. inert gases, are filled into the discharge space.

Conventional PDP having the above structure operates in the method described as follows. Firstly, a reset voltage is applied to the whole panel forming a pre-discharge to erase the wall charge left by the last period of discharge. Secondly, a voltage is applied between the scanning electrodes and the common electrodes to form a glow discharge. When the addressing pulse is writing voltage, the charged particles in the discharging form wall voltage; otherwise the wall voltage is erased depending on the image signals. Lastly, after the initialization line by line for the whole panel according to the video signal sustain pulses with a voltage lower than firing voltage is applied between the scanning electrodes and common electrodes. The panel keeps on discharging and emits light. For a color PDP, ultraviolet rays are emitted from the plasma and excite different phosphor to emit three basic colors, thereby displaying an image.

Another conventional AC PDP structure is matrix AC PDP. The difference between the matrix AC PDP and surface discharge AC PDP lies in that there are no common electrodes on the front substrate. Each scanning electrode and addressing electrode forms a discharge space. The addressing, scanning and erasing of plasma is controlled by the voltage wave applied to the pairs of electrodes. However, conventional AC PDP described above has several drawbacks as follows. Firstly, it is difficult to make the rib walls with equal height, equal width while keeping narrow size in large size with dielectric materials. This causes lower production rate, so does to higher manufacture cost.

Secondly, because of the width of scanning electrodes and common electrodes, it is difficult to make fine pixels along the horizontal direction and improve the definition. Lastly, the drive circuits is complicate with high cost and power consuming because the addressing discharge space are formed by separating the substrates using the high precision rib walls and it is difficult to achieve uniformity for the whole panel.

SUMMARY OF THE INVENTION

An object of present invention is to provide a plasma display panel (PDP), in which, a conductive plate with array of meshes is used as common electrodes, group of orthogonal electrodes are used as addressing and scanning electrodes which can provide high resolution, high brightness, high space ratio and lower working voltage as well as high production rates and low cost.

According to an aspect of the present invention, PDP comprises a rear substrate 1, a front substrate 2; the rear substrate 1 comprises a rear glass plate 4, first electrodes 5 formed on the surface of said rear glass plate 4 and a dielectric layer 6 formed on the surface of said rear glass plate 4 embedding said first electrodes 5 and a protective layer 7 formed on the dielectric layer 6; the front substrate 2 comprises a front glass plate 8, second transparent electrodes 9 formed on the surface of said front glass plate which are orthogonal to said first electrodes 5, dielectric layer 10 formed on the bottom surface of said front glass plate 8 embedding said second electrodes 9 and a protective layer 11 formed on the dielectric layer 10, A conductive plate with array of meshes 3 is sandwiched between the front substrate 2 and the rear substrate 2, which is made by conductive materials in which there are array of meshes, supporting the front substrate 2 and the rear substrate 1; Each mesh in the conductive plate, first electrodes 5 and second electrodes are orthogonal to each other and form discharge cells.

Preferably, gas conductive groove 12 is formed between adjacent meshes on the surface of said conductive plate 3.

Preferably, monochrome ultraviolet phosphor 13 or red, green and blue ultraviolet phosphor 13 are coated on the whole side or some regions of said discharge cell to form a monochrome or chrome PDP.

Preferably, shape of the meshes in said conductive plate with array of meshes 3, can be polygon or ellipse and combinations of various shapes, and the sectional structure can be rectangle, trapezoid, ellipse arc and combinations of various shapes.

Preferably, the meshes of said conductive plate with array of meshes 3 are arranged in parallel or stagger in equal or various interval and random interval. Preferably, said conductive plate with array of meshes 3 are covered by dielectric layer 14.

Preferably, said conductive plate with array of meshes (3), first electrodes (5) and second electrodes (9) made of anti-ion-bombard conductive material or covered by protective film are exposed to the working gas.

Preferably, the shape of meshes in the conductive plate is slot-shape, every mesh is addressed by multi-line. The extreme situation is that only one slot exists.

Preferably, the width of said first electrodes or second electrodes is lager that of the meshes, i.e., one pixel includes several discharge cells. Preferably, said first electrodes or second electrodes are electrodes with array of meshes.

DESCRIPTION OF THE PREFERRED EMBODIMENTS

The PDP described in this invention works in the following method. If first electrodes 5 are used as addressing electrodes, second electrodes 9 are used as scanning electrodes and conductive plate 3 with meshes is used as common electrode, higher narrow pulse voltage of erasing pulse is applied to addressing electrodes and common electrode to erase the wall charge left by the last period discharge. Then an addressing pulse voltage is applied to this line to ignite it. At the same time, the data voltage is applied to the scanning electrode and this voltage is lower than the firing voltage between scanning and common electrodes. It controls discharge process to continue (writing signal) or to stop (erasing signal) to form the required wall charge distribution corresponding to the image to be displayed. After initializing of image discharge of the whole panel line by line, sustain voltage is applied between scanning electrode and common electrode to display the picture of this frame. The progressive frame picture can be obtained by repeating above process. The detailed structure is considered on the basis of above invention and following examples are submitted.

EXAMPLE 1

Figure 1:
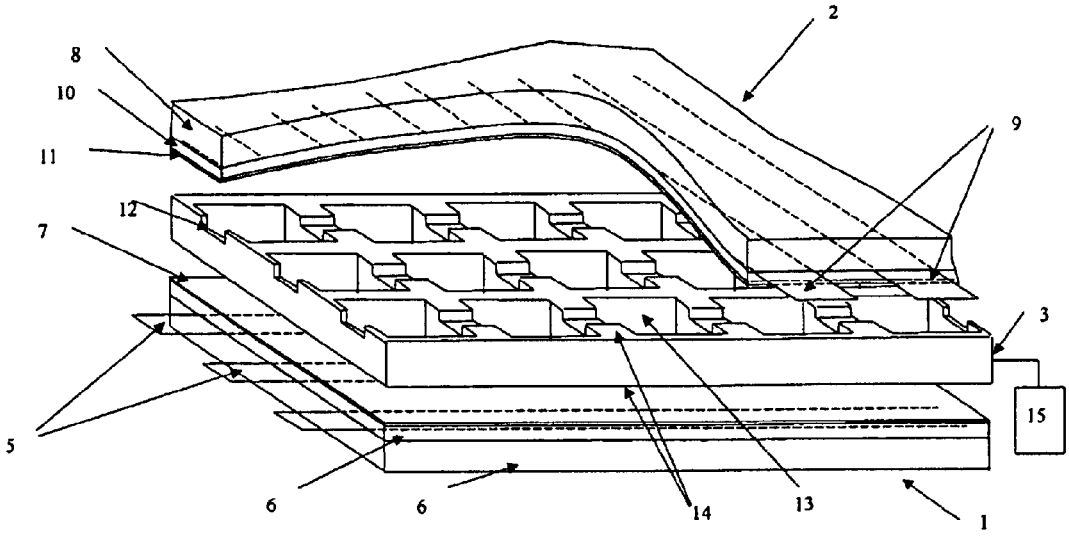
FIG. 1 is perspective view showing a structure of the PDP according to present invention

The first example of this invention includes a rear substrate 1, a front substrate 2 and a conductive plate with meshes 3 as shown in FIG. 1, said rear substrate 1 comprises a rear glass plate 4, first electrodes 5 formed on said rear glass plate 4, a dielectric layer 6 formed on said rear glass 4 embedding said first electrodes 5 and a protecting film 7 coated on said dielectric layer; said front substrate 2 comprises a front glass plate 8, second electrodes 9 formed on the bottom surface of said front glass plate 8 which is transparent and orthogonal to said first electrodes 5, a dielectric layer 10 formed on the surface of said front glass plate 8 embedding said second electrodes 9 and a protective film 11 coated on said dielectric layer 10; said conductive plate with meshes 3 located between said rear substrate 1 and front substrate 2. The conductive plate 3 is made of conductive materials with array of meshes. Each mesh is perpendicular to said first electrode 5 and second electrode 9 which forms a basic discharge cell, that is the lighting element of this plasma display panel. There are grooves along the direction said first electrodes 5 on the surface of said conductive plate with meshes 3 to improve the gas conductivity and decrease the capacitance for high working frequency. Said conductive plate with meshes 3 can be coated with protective layer or made by anti-ion-bombardment material in order to avoid the ion bombardment because it is exposed in the discharge space directly. The conductive plate with meshes 3 is connected to driving circuit 15 through conductive films printed on said rear substrate 1 parallel to said first electrodes 5 outside of the display area. Said first electrode 5 and second electrode 9 are connected to the driving circuit on both ends of said front substrate 2 and rear substrate 1. Rear substrate 1, conductive plate with meshes 3 and front substrate 2 are sealed with lower melting point glass 14 and some working gas with required pressure are filled into it, the plasma display panel provided in this invention is formed.

If said first electrode 5 is used as scanning electrode and said second electrode 9 is used as addressing electrode, the progressive frame picture can be displayed in same method.

After initializing of image discharge of the whole panel as described above, sustain voltage is applied between addressing electrode and common electrode to display the picture of this frame. The progressive frame picture can be displayed in same method.

EXAMPLE 2

Figure 2:
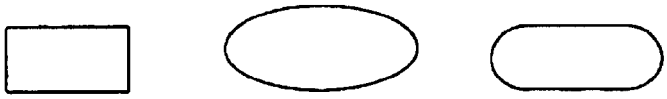
FIG. 2 is a top view of the mesh in the conductive plate. It shows the basic shape and combined shapes of the mesh.
Figure 3:
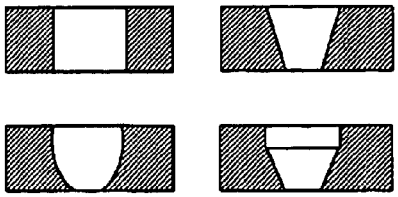
FIG. 3 is a sectional view of the mesh in the conductive plate. It shows the basic shape and combined shapes of the hole.
Figure 4:
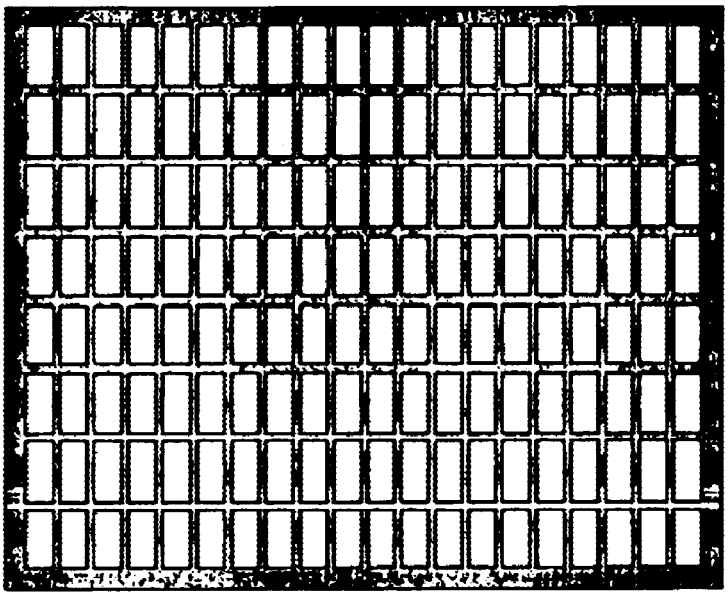
FIG. 4 shows the parallel arrangement of meshes in the conductive plate.
Figure 5:
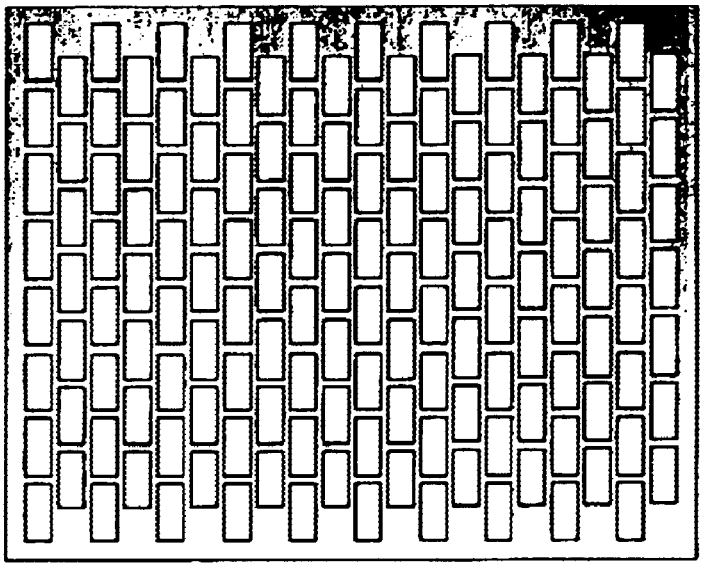
FIG. 5 shows the alternate arrangement of meshes in the conductive plate.
Figure 6:
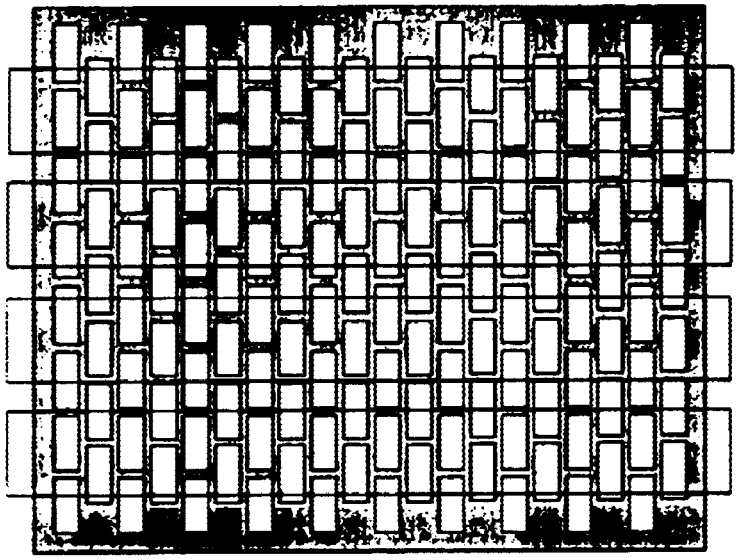
FIG. 6 shows single line addressing multi-rows of meshes
Figure 7:
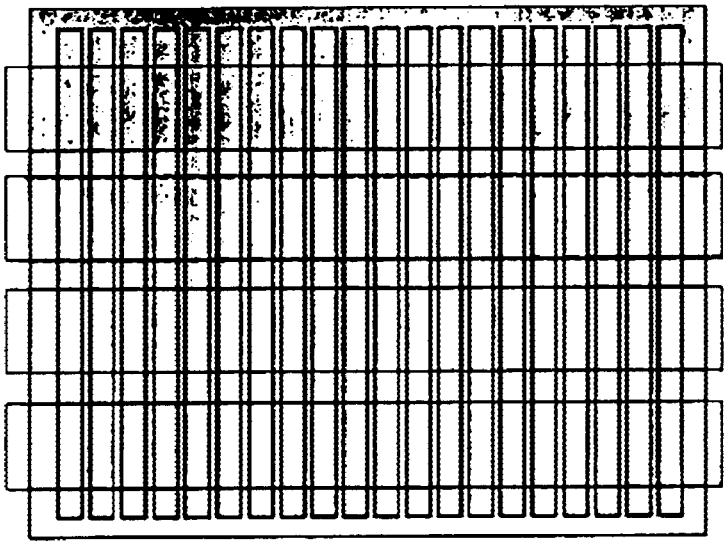
FIG. 7 shows multi-lines addressing single row of meshes

In present example, the shape of the meshes in said conductive plate 3 described in Example 1 can be squares, polygon (including rectangle), ellipse (including circle) etc. as well as the combination of various shapes as shown in FIG. 2. The sectional structure can be rectangle, trapezoid, ellipse arc (including circle arc) etc. as well as the combination of various shapes as shown in FIG. 3. The distribution of said meshes can be parallel arrangement or alternate arrangement. It can be equidistance arrangement or un-equidistance arrangement. It can also be random arrangement.

EXAMPLE 3

In present example, one of the three electrodes, i.e. said conductive plate with array of meshes 3, said first electrodes 5 and said second electrodes 9, is covered by dielectric layer while other electrodes, which are made of anti-ion-bombard conductive material or covered by protective film, are exposed to the working gas; or two of the three electrodes, i.e. said conductive plate with array of meshes 3, said first electrodes 5 and said second electrodes 9, except that said first electrodes 5 and second electrodes 9 are covered by dielectric layer as described in Example 1, are covered by dielectric layer while other electrode, which is made of anti-ion-bombard conductive material or covered by protective film, is exposed to the working gas; or all of the three electrodes, i.e. said conductive plate with array of meshes 3, said first electrodes 5 and said second electrodes 9, are covered by dielectric layer.

EXAMPLE 4

In present example, said first electrodes 5, said second electrodes 9 and conductive plate with array of meshes 3 as described in Example 1 do not cover dielectric layer and are made of anti-ion-bombard conductive material or covered by protective film and exposed to the working gas. This example is a DC PDP.

The PDP described in this invention works in the following method. Said conductive plate 3 with meshes is float or used as common electrode; said first electrodes 5 are used as scanning electrodes, said second electrodes 9 are used as addressing electrodes. An addressing pulse voltage is applied to this line while the data voltage, which is inverse to said addressing pulse and controls discharge process to display the line of the image, is applied to the scanning electrode. The progressive line and frame picture can be obtained by continuing above process.

EXAMPLE 5

In present example, a slot array structure is adopted for said meshes of said conductive plate 3 described in the example 1 to 4. The shape of meshes in the conductive plate is changed into slot-shape, every mesh is addressed by multi-line. The utmost situation is that only one slot exists in the scanning electrode direction.

EXAMPLE 6

In present example, the width of said first electrodes 5 or second electrodes 9 described in the Example 1 to 4 is larger than that of basic discharge cell, i.e., one display pixel includes some discharge cells.

EXAMPLE 7

In present example, said conductive plate with meshes 3 is just used instead of normal rib wall.

EXAMPLE 8

In present example, said first electrodes 5 or second electrodes 9 described in the example 1 to 7 adopt electrodes with array of meshes.

EXAMPLE 9

In present example, ultraviolet phosphor is coated on the whole side or some regions of the discharge cell in example 1 to 8 and some suitable gas is filled into this panel to produce ultraviolet with required wave length to make the phosphor emitting visible light and display picture.

EXAMPLE 10

In present example, red, green and blue ultraviolet phosphors are coated in turns on the whole side or some regions of the discharge cell in example 1 to example 8 and some suitable gas is filled into this panel to produce ultraviolet with required wave length to make the phosphor emitting red, green and blue visible light and display picture.

This invention has obviously advantages and effect comparing with conventional technology. As described above, the PDP described in this invention includes a rear substrate 1, a front substrate 2 and a conductive plate with meshes 3, in which said rear substrate 1 comprises a rear glass plate 4, first electrodes 5 formed on said rear glass plate 4, a dielectric layer 6 formed on said rear glass 4 embedding said first electrodes 5 as well as a protecting film coated on said dielectric layer 7; said front substrate 2 comprises a front glass plate 8, second electrodes 9 formed on the bottom surface of said front glass plate 8 which is transparent and orthogonal to said first electrodes 5, a dielectric layer 10 formed on the surface of said front glass plate 8 embedding said second electrodes 9 and a protective film 11 coated on said dielectric layer 10; said conductive plate with meshes 3 located between said rear substrate 1 and front substrate 2. The conductive plate 3 is made of conductive materials with array of meshes. On the one hand, each mesh is perpendicular to said first electrode 5 and second electrode 9 which forms a basic discharge cell; On the other hand, said conductive plate 3 prevents discharge disturb between discharge cells. Said rear substrate 1, said conductive plate with meshes 3 and said front substrate 2 are sealed with lower melting point glass 14 and some working gas with required pressure are filled into it. Said conductive plate with meshes 3 is connected to driving circuit through conductive films printed on said rear substrate 1 parallel to said first electrodes 5 outside of the display area. Thus the plasma display panel provided in this invention is formed.

This invention has following advantages:

1) Said conductive plate with meshes 3 can be made of metal. The manufacture technology of metal is much simple and mature than that of the dielectric barrier rib used in conventional PDPs, so that this invention is suitable to fabricating in a large quantity, its finished production rate is higher and production cost is lower.
2) For the plasma display panel of this invention, the shortest discharge distance between the conductive plate with meshes electrode 3, the group of first electrode 5 and the group of second electrode 9 is only the thickness of the dielectric layer and the protective layer. The largest discharge distance can be as large as the thickness of the conductive plate with meshes 3. The discharge path can be changed in a large range, this makes the working voltage to be changed also in a large range. It means that all the display cells in the PDP of this invention can get same lowest firing voltage and sustain voltage, this makes design of driving circuit more simple and the set cost lower.
3) Compared with the conventional coplanar PDP, one of the two electrodes on the front substrate of the conventional coplanar PDP is moved to the side of the discharge cell in the plasma display panel of this invention, so the open ratio of the front glass plate is improved.
4) In the plasma display panel of this invention, the meshes of the conductive plate 3 can be made large on the side opposite to the front substrate and small opposite to the rear substrate, this not only guarantee the strength of the conductive plate with meshes 3 but also enhance the lighting area and viewing angle.

In this invention the conductive plate with meshes 3 also acts as barrier ribs, so it can prevent from discharge disturb. Compared with existed structure, it can improve the resolution among picture elements.

While this invention has been particularly shown and described with references to a preferred embodiment thereof, it will be understood by those skilled in the art that various changes in form and details may be made therein without departing from the spirit and scope of the invention as defined by the appended claims.

What is claimed is:

1. A plasma display panel, comprising:

a rear substrate and a front substrate;

said rear substrate including a rear glass plate, first electrodes formed on the surface of said rear glass plate and a first dielectric layer formed on the surface of said rear glass plate embedding said first electrodes and a first protective layer formed on the dielectric layer;

said front substrate including a front glass plate, second transparent electrodes formed on the surface of said front glass plate which being orthogonal to said first electrodes, a second dielectric layer formed on the bottom surface of said front glass plate embedding said second electrodes and a second protective layer formed on the dielectric layer;

a single conductive plate, made of a conductive material, including an array of meshes, the conductive plate located between the front substrate and the rear substrate, supporting the front substrate and the rear substrate with one surface of said conductive plate contacting with said first protective layer on the surface of said rear glass plate and the opposite surface of said conductive plate contacting with said second protective layer on the surface of said front glass plate;

each mesh in the conductive plate, along with said first electrodes and second electrodes form discharge cells, and wherein the first electrodes and second electrodes are orthogonal to each other.

2. The plasma display panel according to claim 1, wherein a gas conductive groove is formed between adjacent meshes on the surface of said conductive plate.

3. The plasma display panel according to claim 1, wherein monochrome ultraviolet phosphors or red, green and blue ultraviolet phosphors are coated on the whole side or some regions of said discharge cell to form a monochrome or chrome PDP.

4. The plasma display panel according to claim 1, wherein the shape of the meshes in said conductive plate is selected for the group of shapes consisting of polygon, ellipse and combinations of various shapes, and a sectional structure of the meshes is selected from the group of sectional structures consisting of rectangle, trapezoid, ellipse arc and combinations of various shapes.

5. The plasma display panel according to claim 1, wherein the meshes of said conductive plate with an array of meshes are arranged in parallel or stagger in equal or various interval or random interval.

6. The plasma display panel according to claim 1, wherein said conductive plate with an array of meshes is covered by a third dielectric layer.

7. The plasma display panel according to claim 1, wherein said conductive plate with an array of meshes, covered by a third protective film and then exposed to a working gas.

8. The plasma display panel according to claim 1, wherein the shape of the meshes in the conductive plate is slot-shape, every hole being addressed by a multi-line driving circuit.

9. The plasma display panel according to claim 1, wherein the width of said first electrodes or said second electrodes is larger than that of the meshes.

10. A plasma display panel, comprising:

a rear substrate and a front substrate;

said rear substrate including a rear glass plate, first electrodes formed on the surface of said rear glass plate and a first dielectric layer formed on the surface of said rear glass plate embedding said first electrodes and a first protective layer formed on the dielectric layer;

said front substrate including a front glass plate, second transparent electrodes formed on the surface of said front glass plate which being orthogonal to said first electrodes, a second dielectric layer formed on the bottom surface of said front glass plate embedding said second electrodes and a second protective layer formed on the dielectric layer;

a single conductive plate, made of a conductive material, including an array of meshes, the conductive plate located between the front substrate and the rear substrate, supporting the front substrate and the rear substrate with one surface of said conductive plate contacting with said first protective layer on the surface of said rear glass plate and the opposite surface of said conductive plate contacting with said second protective layer on the surface of said front glass plate;

each mesh in the conductive plate, the conductive plate with meshes connected to driving circuit through conductive films formed on said rear substrate parallel to said first electrodes outside of the display area, said the conductive plate with meshes, along with first electrodes and second electrodes form discharge cells.

11. The plasma display panel according to claim 10, wherein a gas conductive groove is formed between adjacent meshes on the surface of said conductive plate.

12. The plasma display panel according to claim 10, wherein monochrome ultraviolet phosphors or red, green and blue ultraviolet phosphors are coated on the whole side or some regions of said discharge cell to form a monochrome or chrome PDP.

13. The plasma display panel according to claim 10, wherein the shape of the meshes in said conductive plate is selected for the group of shapes consisting of polygon, ellipse and combinations of various shapes, and a sectional structure of the meshes is selected from the group of sectional structures consisting of$_{13}$rectangle, trapezoid, ellipse arc and combinations of various shapes.

14. The plasma display panel according to claim 10, wherein the meshes of said conductive plate with an array of meshes are arranged in parallel or stagger in equal or various interval or random interval.

15. The plasma display panel according to claim 10, wherein said conductive plate with an array of meshes is covered by a third dielectric layer.

16. The plasma display panel according to claim 10, wherein said conductive plate with an array of meshes is covered by a third protective film and the conductive plate, first electrodes and second are all exposed to a working gas.

17. The plasma display panel according to claim 10, wherein the shape of the meshes in the conductive plate is slot-shape, every hole being addressed by a multi-line driving circuit.

18. The plasma display panel according to claim 10, wherein the width of said first electrodes or said second electrodes is larger that that of the meshes.

* * * * *